US009666934B2

(12) United States Patent
Lombardi et al.

(10) Patent No.: US 9,666,934 B2
(45) Date of Patent: May 30, 2017

(54) ANTENNA LINK IN ULTRA-THIN DEVICE WITH SINGLE-PIECE METAL HOUSING

(71) Applicant: Motorola Mobility LLC, Chicago, IL (US)

(72) Inventors: Michael J Lombardi, Lake Zurich, IL (US); Mohammed Abdul-Gaffoor, Palatine, IL (US); Joseph L Allore, Mundelein, IL (US); Joshua D Boerman, Lake Zurich, IL (US); Ugur Olgun, Waukegan, IL (US); Abu T Sayem, Gurnee, IL (US)

(73) Assignee: Motorola Mobility LLC, Chicago, IL (US)

( * ) Notice: Subject to any disclaimer, the term of this patent is extended or adjusted under 35 U.S.C. 154(b) by 93 days.

(21) Appl. No.: 14/681,879

(22) Filed: Apr. 8, 2015

(65) Prior Publication Data

US 2016/0301139 A1 Oct. 13, 2016

(51) Int. Cl.
*H01Q 1/24* (2006.01)
*H01Q 1/42* (2006.01)
*H01Q 21/30* (2006.01)

(52) U.S. Cl.
CPC ..... *H01Q 1/243* (2013.01); *H01Q 1/42* (2013.01); *H01Q 21/30* (2013.01)

(58) Field of Classification Search
CPC ..... H01Q 9/0407; H01Q 1/36
USPC ..... 343/702, 745
See application file for complete search history.

(56) References Cited

U.S. PATENT DOCUMENTS 6,138,050 A * 10/2000 Schneider ..... G06F 3/0231 341/22
8,779,999 B2 * 7/2014 Gummalla ..... G06F 1/1656 343/702
9,209,513 B2 * 12/2015 Ely ..... C23C 14/16
2014/0112511 A1 * 4/2014 Corbin ..... H05K 9/006 381/333
2014/0375515 A1 * 12/2014 Qiu ..... H01Q 1/243 343/745

OTHER PUBLICATIONS

Joseph L Allore, et al., "Single-Piece Metal Housing with Integral Antennas", U.S. Appl. No. 14/613,406, filed Feb. 4, 2015.

* cited by examiner

*Primary Examiner* — Peguy Jean Pierre
(74) *Attorney, Agent, or Firm* — Miller, Matthias & Hull LLP

(57) ABSTRACT

An enhanced portable communication device includes a one-piece metal back plate with integral antennas. The one-piece metal back plate includes four integral antennas in an embodiment, forming an antenna pair at each end of the device. A printed circuit board (PCB) of the device is configured to drive one or more of the antennas capacitivly or, in an embodiment, via a direct feed.

20 Claims, 12 Drawing Sheets

ANTENNA LINK IN ULTRA-THIN DEVICE WITH SINGLE-PIECE METAL HOUSING

TECHNICAL FIELD

The present disclosure is related generally to mobile electronic device construction, and, more particularly, to a system and method for linking to one or more antennas in a device having a single-piece metal housing design with integral antennas.

BACKGROUND

In an effort to deliver more premium electronic devices to consumers, cellular phone manufacturers are increasingly using exterior cosmetic housings fabricated from metal alloys. However, the use of metal for an exterior housing in high capability phones or "smartphones" currently requires complex manufacturing techniques. For example, one technique that is used to provide a metal exterior while maintaining the electrical isolation needed by current antenna technology requires the manufacturer to form a segmented metal housing having multiple pieces which are held together by a plastic resin. In particular, the plastic divisions in the metal allow the separate exterior metal pieces to act as antennas while maintaining separation from each other and/or from grounded pieces of metal.

While this technique may provide the needed electrical isolation, it does so at the expense of device integrity. Significant metal to plastic interlock geometry is required to keep the plastic and metal from detaching, and the multiple plastic divisions are cosmetically undesirable. Moreover, only certain grades of plastic may be used, since the plastic must typically survive subsequent processing steps such as molding, anodizing and so on. This limit on usable plastics may also limit other aspects of the device such as color. Moreover, when plastic divisions run across the full width of a device, a double wall section (metal plus plastic) contributes to device thickness.

Finally, it will be appreciated that such devices often require I/O (input/output) ports to fall in the middle of a functional antenna element. Not only does this placement physically disrupt the antenna element, but it may also lead to coupling between the antenna element and the port, requiring that additional precautions be taken.

Certain other devices use a perimeter metal housing instead of a full metal back housing. However, this configuration does not solve the above-noted deficiencies. For example, the corners of the housing in these devices are often used as antennas, and therefore four or more perimeter separators of nonconductive material are needed to isolate the four antennas.

While the present disclosure is directed to a system that can eliminate some of the shortcomings noted in this Background section, it should be appreciated that any such benefit is not a limitation on the scope of the disclosed principles, nor of the attached claims, except to the extent expressly noted in the claims. Additionally, the discussion of technology in this Background section is reflective of the inventors' own observations, considerations, and thoughts, and is in no way intended to accurately catalog or comprehensively summarize the prior art. As such, the inventors expressly disclaim this section as admitted or assumed prior art with respect to the discussed details. Moreover, the identification herein of a desirable course of action reflects the inventors' own observations and ideas, and should not be assumed to indicate an art-recognized desirability.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Figure 1:
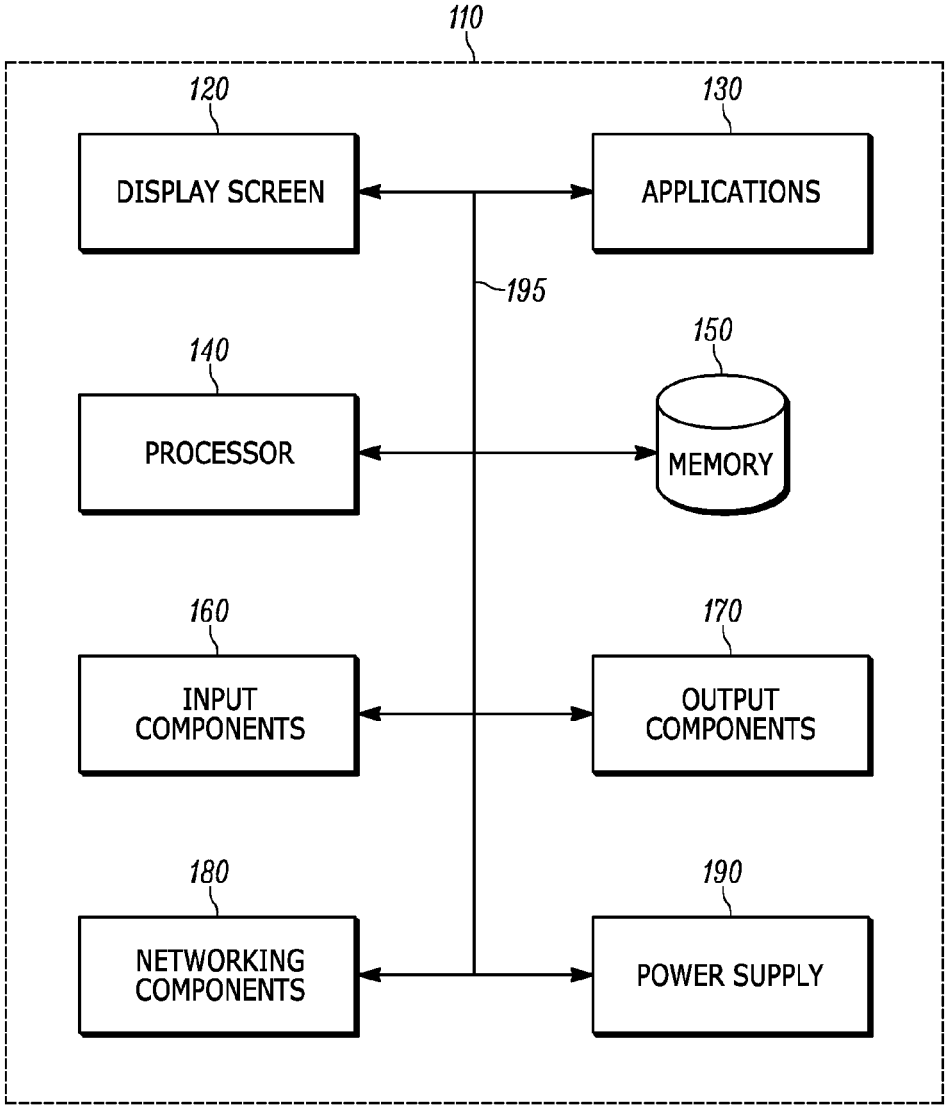
FIG. 1 is a simplified schematic of an example component set with respect to which embodiments of the presently disclosed principles may be implemented.

Before presenting a detailed discussion of embodiments of the disclosed principles, an overview of certain embodiments is given to aid the reader in understanding the later discussion. As noted above, the use of metal for the exterior of a wireless communication device often entails compromises that affect the device functionality and aesthetic appeal. For example, the metal housing must be divided to electrically isolate certain sections for use as antennas. This results in unsightly plastic joint sections and requires extra care when locating an I/O port through an antenna element.

Thus, the inventors have previously conceived to employ a single-piece metal exterior housing having a plurality of arms. These arms are able to function as antennas in the finished device. In an example wherein four such arms are included, the housing may be configured with two arms at one end of the housing and two arms at the opposite end of the housing.

The use of an all-metal housing such as that described herein allows for unique and effective antenna linking strategies to ensure the best available antenna performance within a small device. In embodiments, both direct and indirect linking are provided. In an embodiment, a printed circuit board (PCB) is configured and located to rest against the inside of the rear surface of the metal housing to carry antenna signals to and from a mobile chipset.

Several different approaches for using portions of the single-piece metal housing as functional antennas are enabled. In one embodiment, direct contact is provided from the PCB to an antenna portion of the housing. In an alternative embodiment, direct contact is provided from the PCB to an interior plastic carrier with a plated antenna element on it, such that the plated element then capacitivly couples to an antenna portion of the metal housing. No physical contact between the plated antenna element and metal housing occurs.

In addition, a contactless solution is provided wherein an antenna element is created on or in the PCB such that it runs substantially parallel to an antenna portion of the metal housing, thus creating a capacitive coupling effect between the antenna trace on the PCB and the antenna portion of the metal housing. No physical contact between the metal PCB trace and metal housing occurs.

With respect to capacitive antenna coupling, consistent proximity of the traces to the housing arms is beneficial to promote optimum antenna performance. To this end, different techniques are disclosed for ensuring consistent proximity with respect to capacitivly coupled embodiments.

With this overview in mind, and turning now to a more detailed discussion in conjunction with the attached figures, the techniques of the present disclosure are illustrated as being implemented in a suitable computing environment. The following device description is based on embodiments and examples of the disclosed principles and should not be taken as limiting the claims with regard to alternative embodiments that are not explicitly described herein. Thus, for example, while FIG. 1 illustrates an example mobile device within which embodiments of the disclosed principles may be implemented, it will be appreciated that other device types may be used, including but not limited to personal computers, tablet computers and other devices.

The schematic diagram of FIG. 1 shows an exemplary device 110 forming part of an environment within which aspects of the present disclosure may be implemented. In particular, the schematic diagram illustrates a user device 110 including several exemplary components. It will be appreciated that additional or alternative components may be used in a given implementation depending upon user preference, component availability, price point, and other considerations.

In the illustrated embodiment, the components of the user device 110 include a display screen 120, applications (e.g., programs) 130, a processor 140, a memory 150, one or more input components 160 such as speech and text input facilities, and one or more output components 170 such as text and audible output facilities, e.g., one or more speakers.

The processor 140 can be any of a microprocessor, microcomputer, application-specific integrated circuit, or the like. For example, the processor 140 can be implemented by one or more microprocessors or controllers from any desired family or manufacturer. Similarly, the memory 150 may reside on the same integrated circuit as the processor 140. Additionally or alternatively, the memory 150 may be accessed via a network, e.g., via cloud-based storage. The memory 150 may include a random access memory (i.e., Synchronous Dynamic Random Access Memory (SDRAM), Dynamic Random Access Memory (DRAM), RAMBUS Dynamic Random Access Memory (RDRM) or any other type of random access memory device). Additionally or alternatively, the memory 150 may include a read only memory (i.e., a hard drive, flash memory or any other desired type of memory device).

The information that is stored in the memory 150 can include program code associated with one or more operating systems or applications as well as informational data, e.g., program parameters, process data, etc. The operating system and applications are typically implemented via executable instructions stored in a non-transitory computer readable medium (e.g., memory 150) to control basic functions of the electronic device 110. Such functions may include, for example, interaction among various internal components and storage and retrieval of applications and data to and from the memory 150.

Further with respect to the applications, these typically utilize the operating system to provide more specific functionality, such as file system service and handling of protected and unprotected data stored in the memory 150. Although many applications may provide standard or required functionality of the user device 110, in other cases applications provide optional or specialized functionality, and may be supplied by third party vendors or the device manufacturer.

Finally, with respect to informational data, e.g., program parameters and process data, this non-executable information can be referenced, manipulated, or written by the operating system or an application. Such informational data can include, for example, data that are preprogrammed into the device during manufacture, data that are created by the device or added by the user, or any of a variety of types of information that are uploaded to, downloaded from, or otherwise accessed at servers or other devices with which the device is in communication during its ongoing operation.

The device 110 includes software and hardware networking components 180 to allow communications to and from the device via antennas (not shown in FIG. 1). Such networking components 180 will provide wireless networking functionality, although wired networking may additionally be supported.

In an embodiment, a power supply 190, such as a battery or fuel cell, is included for providing power to the device 110 and its components. All or some of the internal components communicate with one another by way of one or more shared or dedicated internal communication links 195, such as an internal bus. It will be appreciated that in practice, some or all of the components 110 are supported on and linked by a PCB as described above.

In an embodiment, the device 110 is programmed such that the processor 140 and memory 150 interact with the other components of the device 110 to perform a variety of functions. The processor 140 may include or implement various modules and execute programs for initiating different activities such as launching an application, transferring data, and toggling through various graphical user interface objects (e.g., toggling through various display icons that are linked to executable applications).

Figure 2:
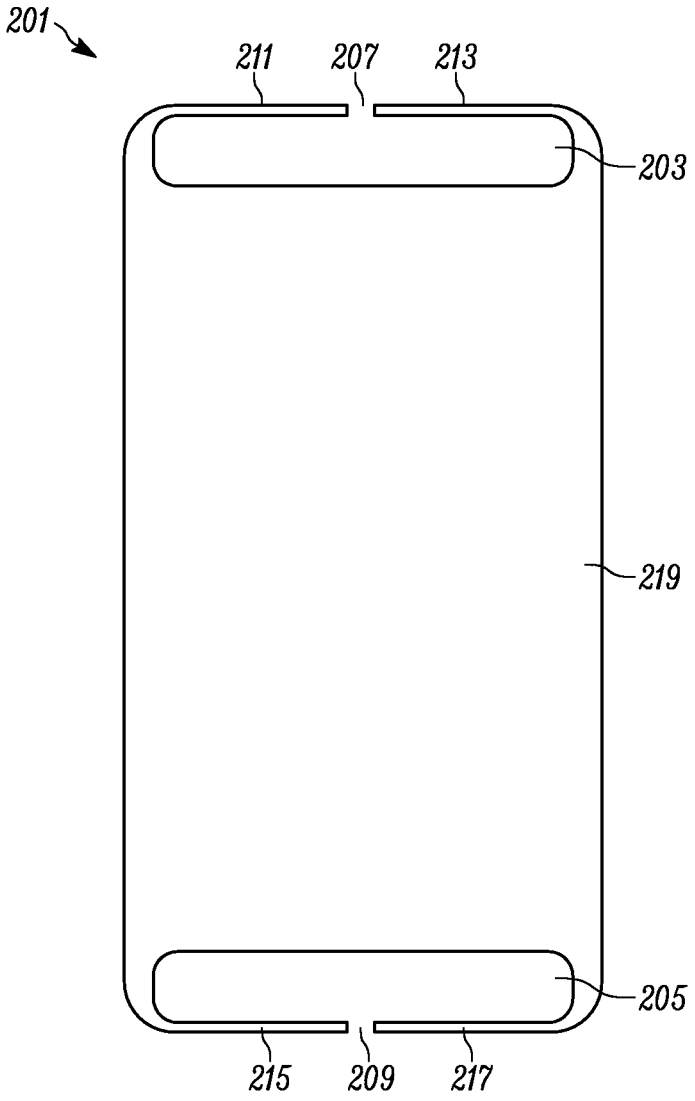
FIG. 2 is a plan view of a one-piece metal back plate usable in implementing an embodiment of the described principles.

Turning to FIG. 2, this figure shows a metal back plate 201 for a portable communication device such as one having the components shown in FIG. 1. In the illustrated example, the metal back plate 201 is formed having a first opening 203 and a second opening 205, with the first opening 203 being located in the upper portion of the metal back plate 201 and the second opening 205 being located in the lower portion of the metal back plate 201.

In addition, a break 207 is located in the top of the metal back plate 201, causing the opening 203 to be non-closed. Similarly, a break 209 is located in the bottom of the metal back plate 201, causing the opening 205 to be non-closed. The result of the first opening 203, the second opening 205, the first break 207 and the second break 209 is to cause a pair of antenna arms to be formed at both the top and the bottom of the metal back plate 201. In particular, a pair of antenna arms 211, 213 is formed at the top of the metal back plate 201 and another pair of antenna arms 215, 217 is formed at the bottom of the metal back plate 201. The remainder of the metal back plate 201 may be referred to herein as the main body 219 of the metal back plate 201.

Figure 3:
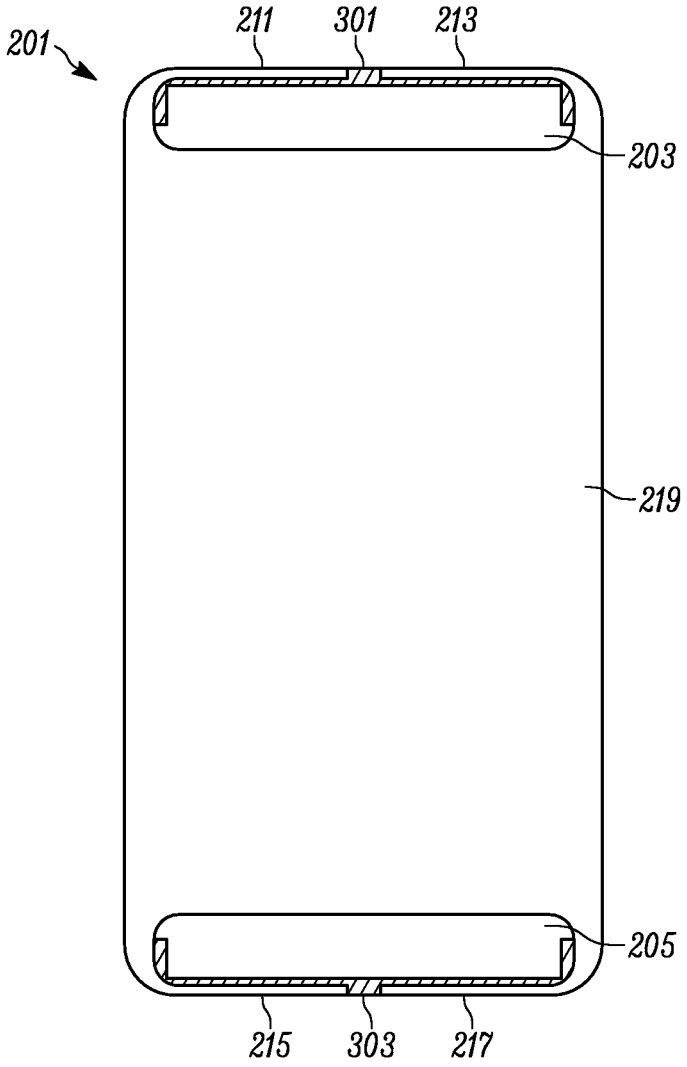
FIG. 3 is a plan view of the one-piece metal back plate of FIG. 2, further including antenna spacers in accordance with an embodiment of the described principles.

FIG. 3 illustrates the metal back plate 201 of FIG. 2 with additional structures thereon. In particular, the metal back plate 201 as shown in FIG. 3 includes a first spacer 301 bridging the gap between the antenna arms 211, 213. The spacer is made of plastic or other non-conducting material and includes material within the opening 203 to stabilize the spacer 301 and to insulate other elements.

Similarly, the bottom opening 205 in the metal back plate 201 includes a gap between the pair of antenna arms 215, 217. In the embodiment illustrated in FIG. 3, this gap is bridged via a second spacer 303 between the antenna arms 215, 217. As with the first spacer, the second spacer is made of plastic or other non-conducting material and includes material within the opening 205 to stabilize the spacer 303 and to insulate other elements.

Figure 4:
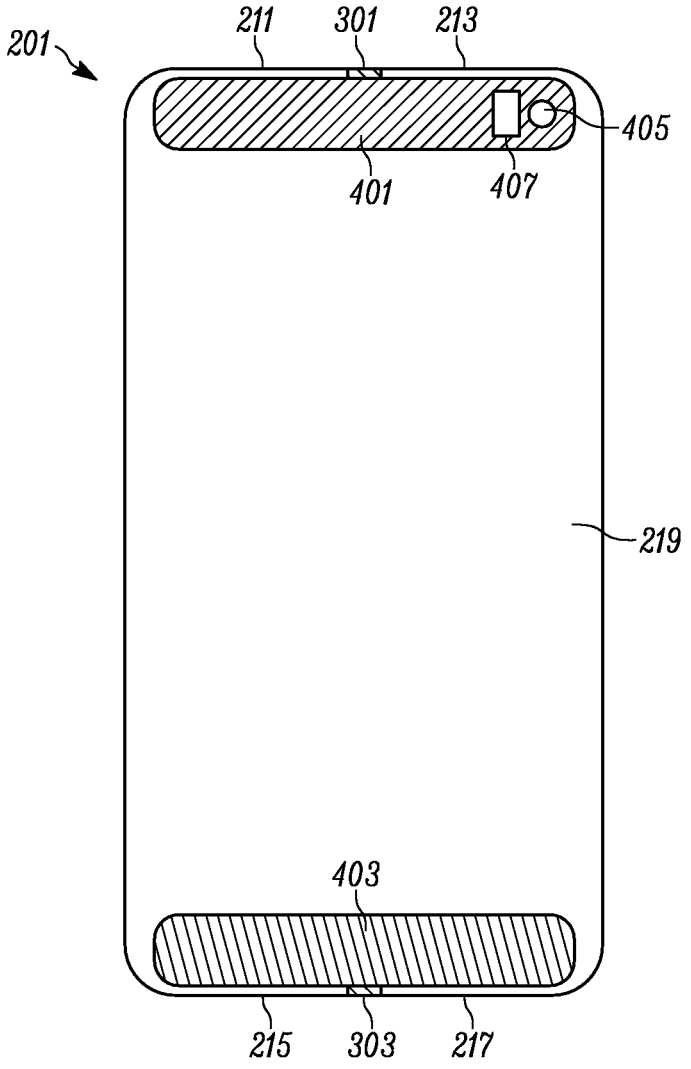
FIG. 4 is a plan view of the one-piece metal back plate of FIGS. 2 and 3, further including additional elements in accordance with an embodiment of the described principles.

Continuing, FIG. 4 illustrates the metal back plate 201 with the openings 203, 205 filled with a nonconductive material 401, 403. This material 401, 403 closes the metal back plate 201 and allows the mounting of externally facing equipment. For example, in the illustrated embodiment, the nonconductive material 401 filler in the top portion of the metal back plate 201 is used as a mount for a camera 405 and an accompanying flash 407. It will be appreciated that additional or alternative equipment may be mounted in the nonconductive material 401, 403 at the top or bottom of the metal back plate 201. Indeed, it is not required to mount any equipment at all in either location.

Figure 5:
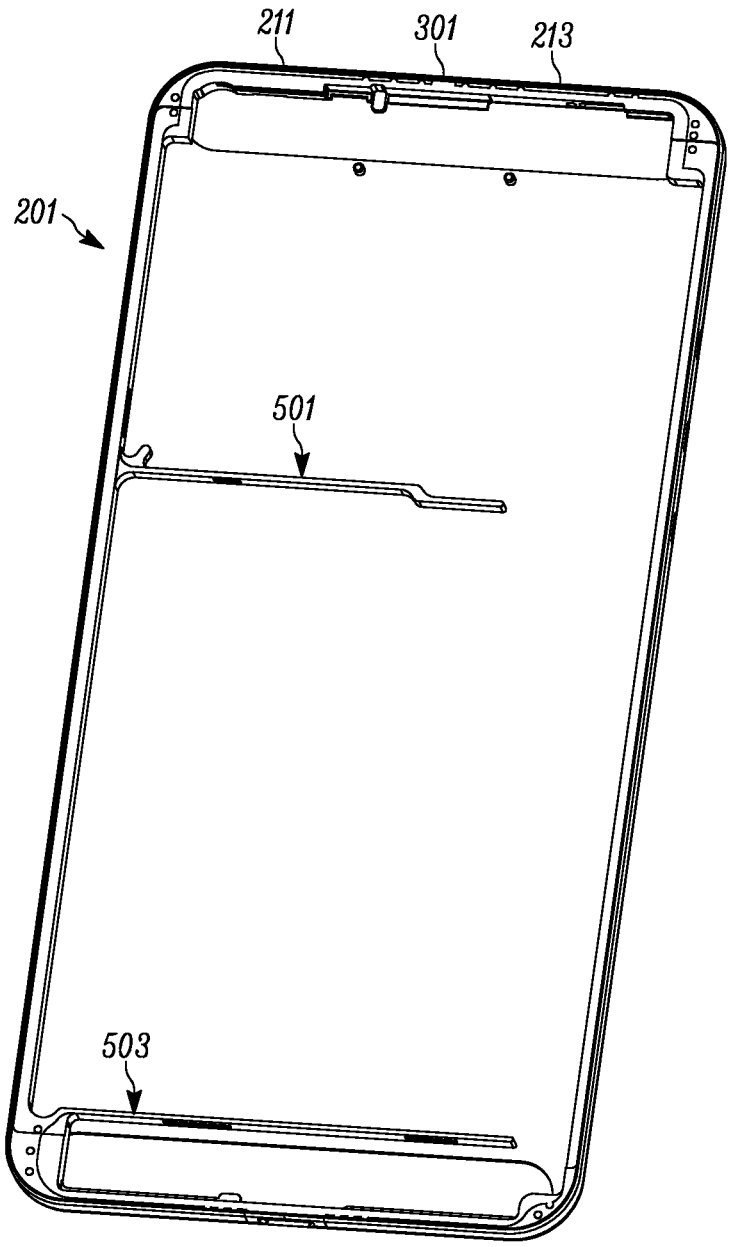
FIG. 5 is a perspective view of the one-piece metal back plate of FIGS. 2-4, further including stiffening ribs in accordance with an embodiment of the disclosed principles.

FIG. 5 is a front perspective view of the metal back plate 201 showing the placement of a first stiffening rib 501 and a second stiffening rib 503. Each rib 501, 503 is integral with the one-piece metal back plate 201, and extends out of the major plane of the main body 219 of the one-piece metal back plate 201. As will be noted later, the ribs may also function as separators and attachment points.

Although the internal device components are not shown in this view, device thinness can be maintained by locating the ribs between internal device components such as batteries, PCBs, hatches and the like. Moreover, the ribs 501, 503 need not be straight, but may include turns, angles, notches and other features allowing the rib to clear internal device components.

In the illustrated example, neither rib 501 nor rib 503 entirely traverses the one-piece metal back plate 201, and the first rib 501 is jogged rather than uniformly straight. These shapes are configured to directly accept a battery and printed circuit board in an implementation of the described principles, as will be more fully described with respect to later figures.

Although the illustrated embodiment utilizes two ribs for the sake of example, those of skill in the art will understand that a greater or lesser number of ribs may be used as reinforcement. Moreover, while the ribs 501, 503 are shown generally traversing the major axis 505 of the one-piece metal back plate 201, and while some transverse element is desired in each rib, one or both ribs 501, 503 may be directed or formed in such a way that they do not actually touch the major axis 505.

Figure 6:
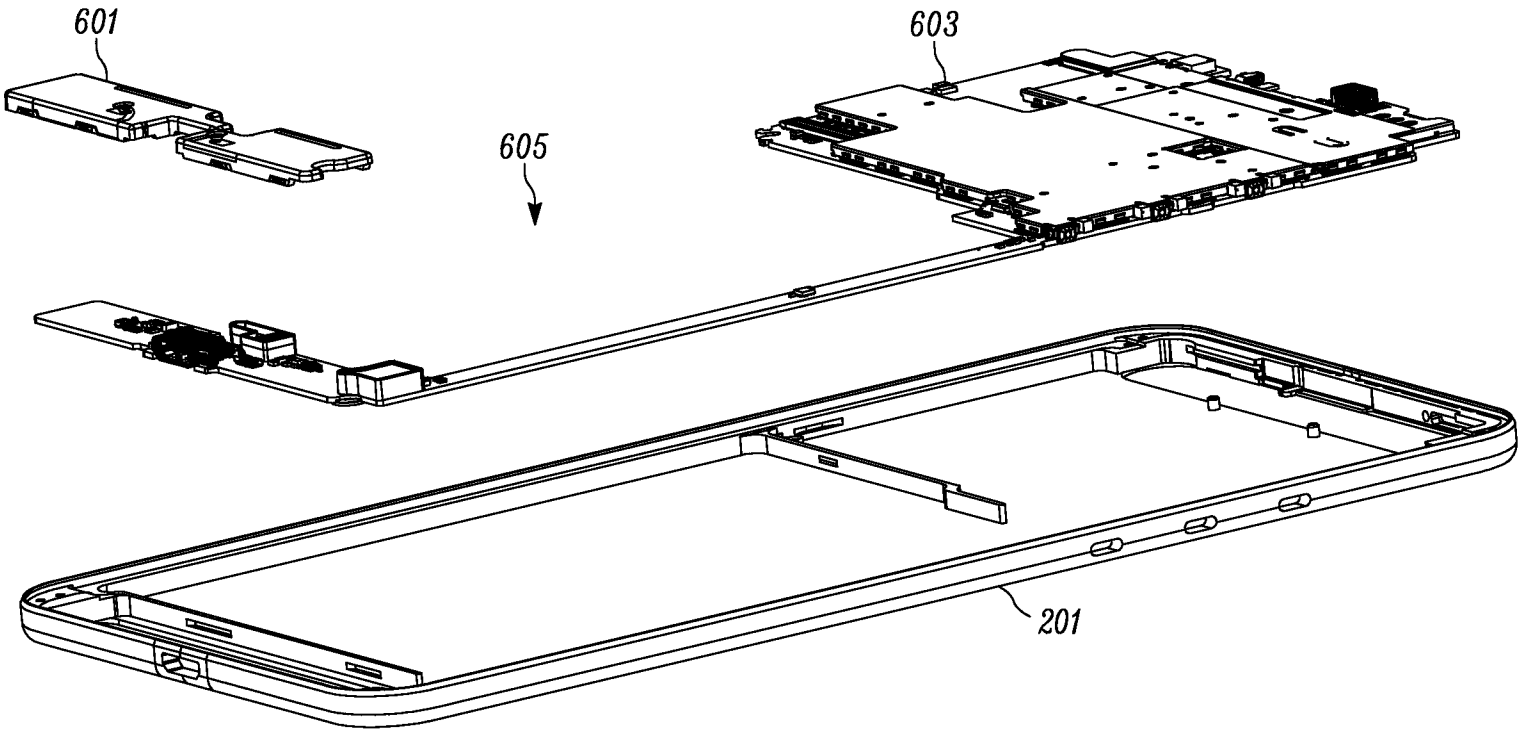
FIG. 6 is a perspective view of the one-piece metal back plate of FIGS. 2-4, as well as the main printed circuit board and a plated antenna carrier prior to assembly in accordance with an embodiment of the disclosed principles.

Turning to FIG. 6, this figure illustrates the primary modules of a device having an all-metal housing 201 in an embodiment of the disclosed principles. In particular, the illustrated modules, in addition to the housing 201 itself, include a plated antenna carrier 601 and a main PCB 603. The plated antenna carrier 601 will be shown in greater detail in later figures. The main PCB 603 includes an opening 605 shaped to accept a battery.

Figure 7:
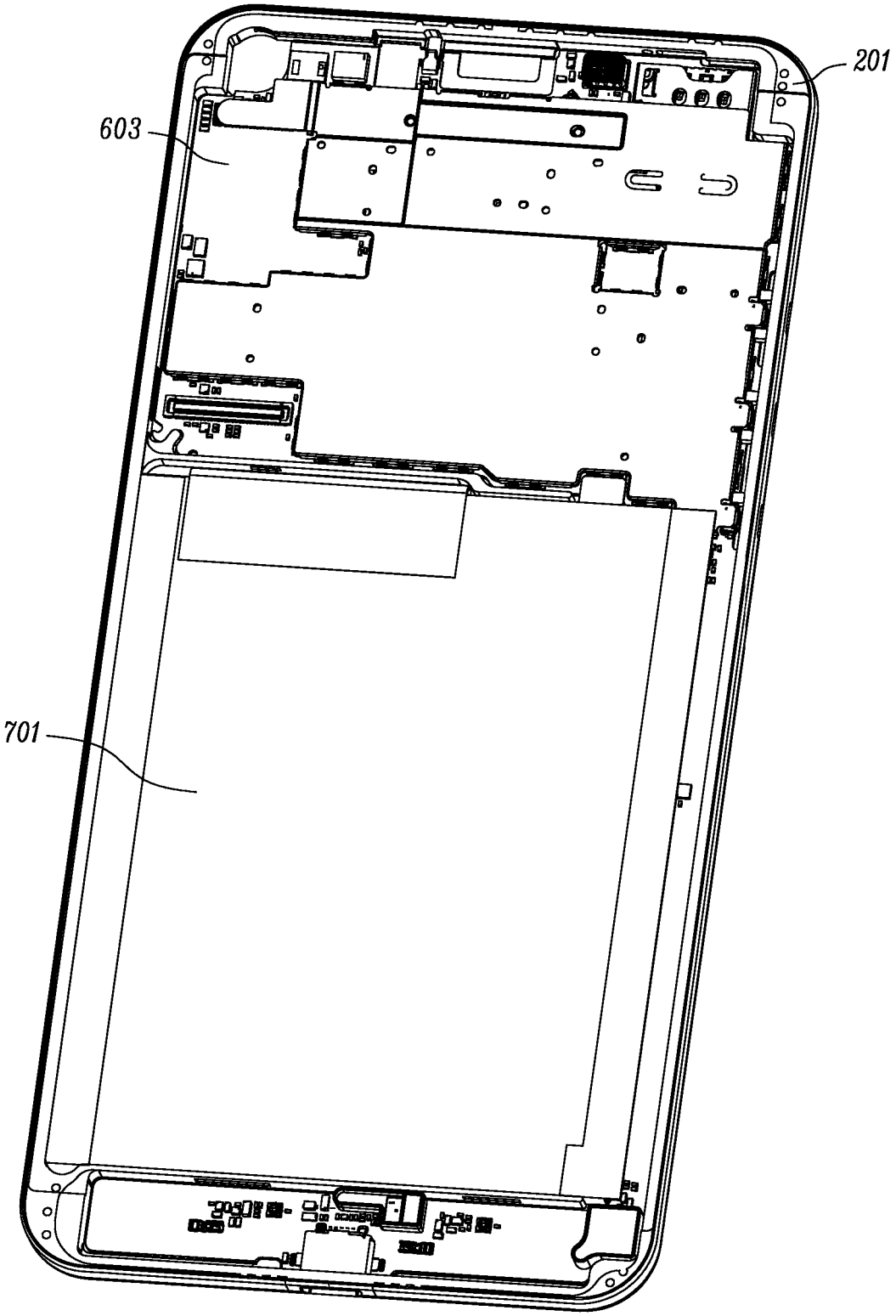
FIG. 7 is a perspective view of the one-piece metal back plate of FIGS. 2-4, with the printed circuit board and battery installed in accordance with an embodiment of the disclosed principles.
Figure 8:
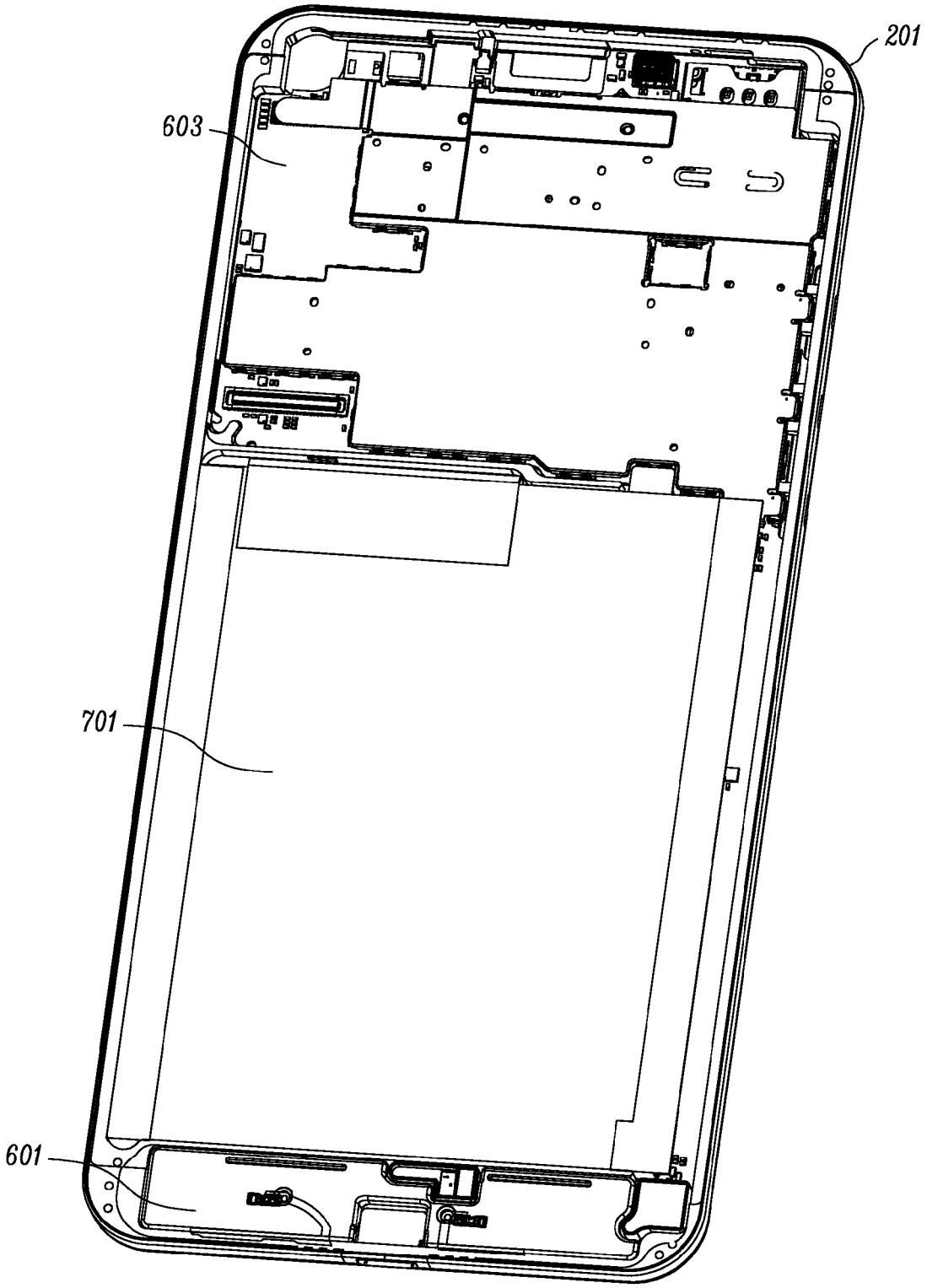
FIG. 8 is a perspective view of the assembly of FIG. 7, further showing an installed plated antenna carrier in accordance with an embodiment of the disclosed principles.

FIG. 7 shows the assembled housing 201 and main PCB 603, with the battery 701 (e.g., power source 190 of FIG. 1) installed in the opening 605. Similarly, FIG. 8 shows the assembly of FIG. 7, with the additional installation of the plated antenna carrier 601. The antenna carrier 601 includes a feed point where a contact on the PCB 603 makes electrical connection to a metal trace to be described below.

Figure 9:
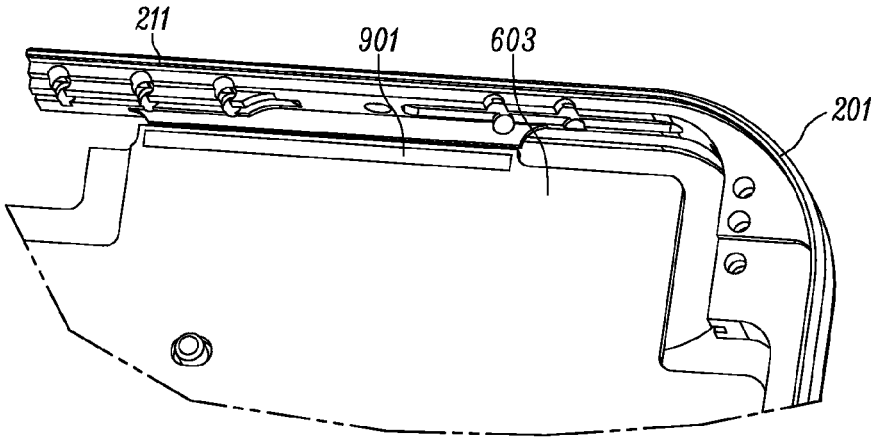
FIG. 9 is a magnified view of a corner of the printed circuit board in an embodiment, showing an antenna coupling trace on the printed circuit board.

In lieu of the plated antenna carrier 601, the device antenna coupling may be implemented via one or more conductive traces on the main PCB 603 as shown in FIG. 9. More specifically, an antenna trace 901 is formed on the main PCB 603 in the form of a length of conductive metal. In an embodiment, the antenna trace 901 is formed as a surface level trace in the same manner as other traces on the PCB 603, e.g., via selective removal of a metal layer or via metal printing techniques.

The antenna trace 901 may alternatively be internal, e.g., between different layers of the main PCB 603. In either case, consistency of antenna coupling is assured by maintaining the antenna trace 901 at a set distance from the metal antenna arm 213. This allows the antenna trace 901 on the board to capacitivly couple in a consistent manner with the antenna 213.

Figure 10:
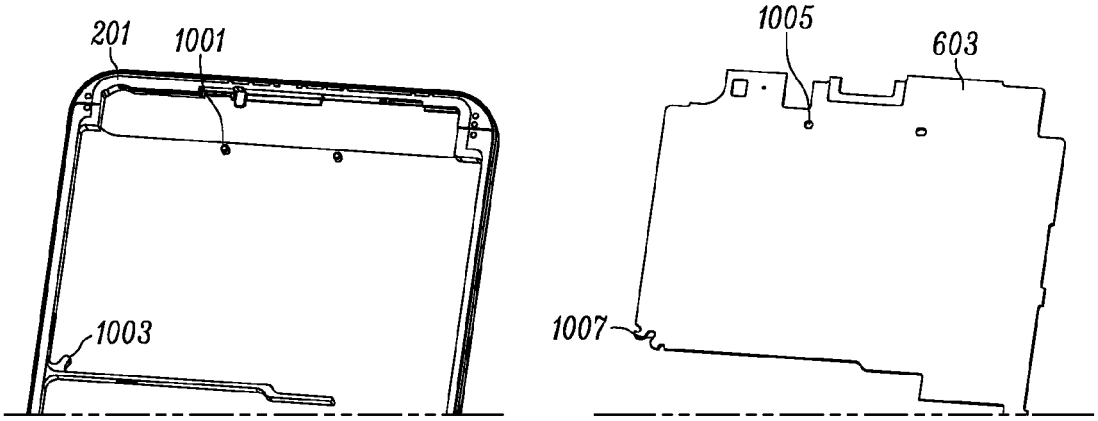
FIG. 10 is a partial perspective view of a back plate and printed circuit board showing alignment features in accordance with an embodiment of the disclosed principles.

To this end, an alignment system may be used to ensure consistent location of the main PCB 603 relative to the housing 201. An example alignment system is shown in FIG. 10. The illustrated embodiment utilizes one or more alignment pins 1001 and one or more alignment keys 1003 on a mounting surface on the inside of the housing 201. The alignment pins 1001 and alignment keys 1003 may be machined, molded or pinned into the housing 201.

The main PCB 603 has one or more holes 1005 formed or drilled in the board 603, and one or more slots 1007 to tightly control the position and rotation of the PCB 603 relative to the housing 201. The spatial arrangement of the one or more holes 1005 and one or more slots 1007 in the main PCB 603 mirrors the spatial arrangement of the one or more alignment pins 1001 and one or more alignment keys 1003 on the housing 201.

Figure 11:
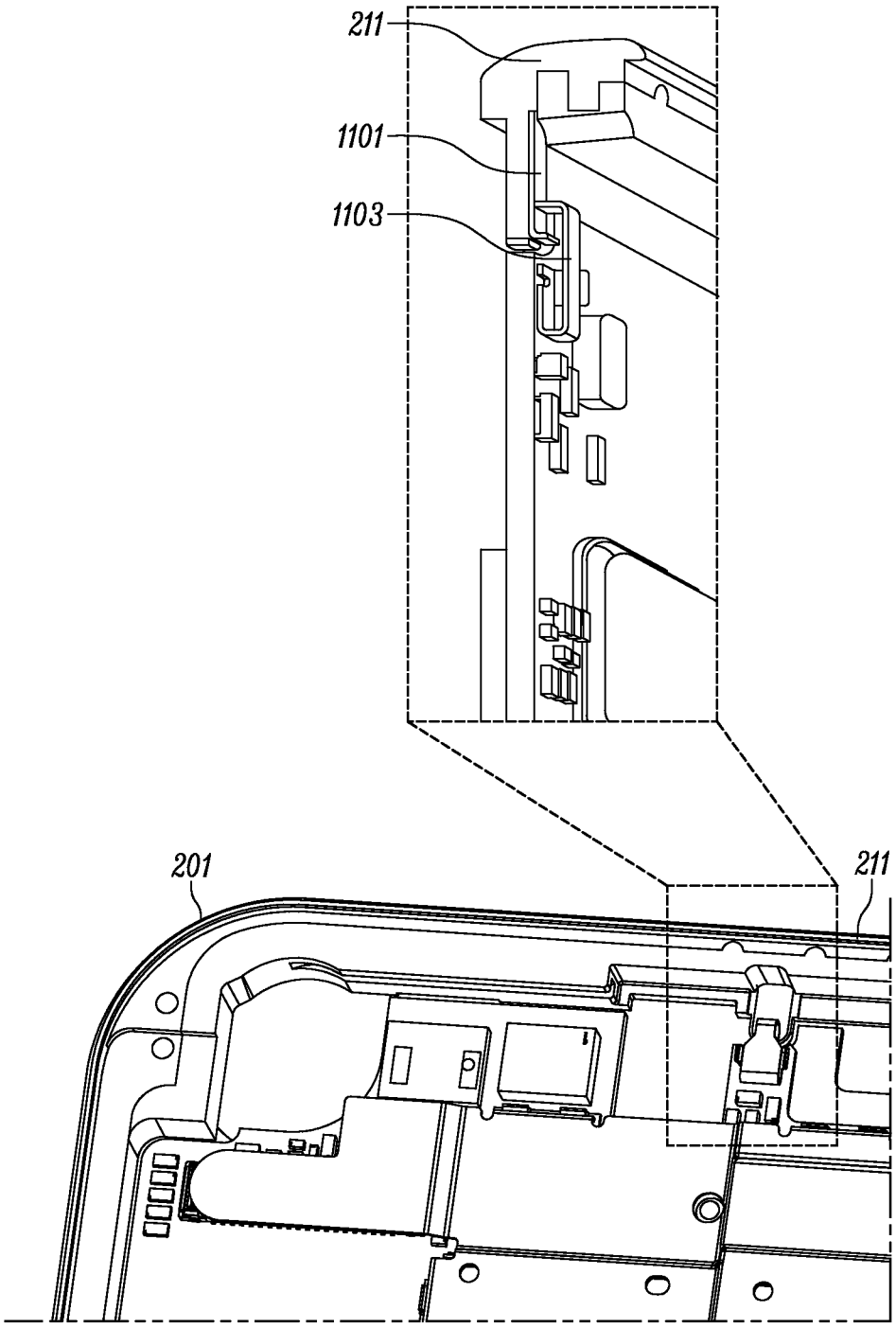
FIG. 11 is a perspective view and coupled cross-sectional view of a direct antenna connection mechanism in accordance with an embodiment of the disclosed principles.

As noted earlier, another technique for coupling to the antennas from the main PCB 603 is to directly connect from the PCB 603 to one or more of the antennas. FIG. 11 illustrates a configuration for such a direct connection in accordance with an embodiment of the disclosed principles. In the illustrated embodiment, a tab 1101 is formed on an antenna 211 of the housing 201. A mating spring contact 1103 on the main PCB 603 is biased into contact with the tab 1101 when the PCB 603 is located in its installed position.

Figure 12:
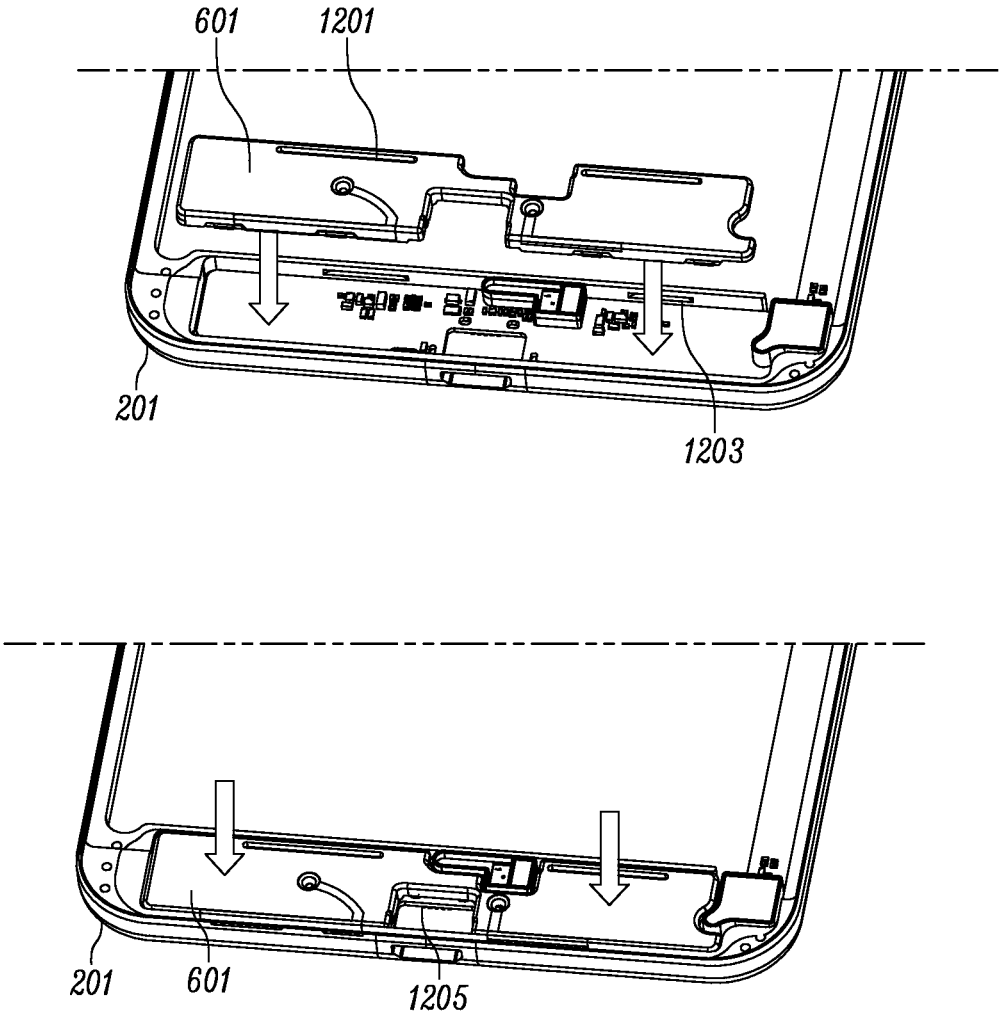
FIG. 12 is a set of partial perspective views showing installation of a plated antenna carrier in accordance with an embodiment of the disclosed principles.

With respect to the attachment of the plated antenna carrier 601 into the housing 201, FIG. 12 illustrates a system of snap pockets that are molded or machined into both the metal and plastic areas of the overmolded metal housing. In the illustrated embodiment, a pair of slots 1201 formed in a plastic portion of the plated antenna carrier 601 allow the perimeter of the plated antenna carrier 601 at the slots 1201 to deflect and then engage into mating pockets 1203 in the metal housing 201.

Figure 13:
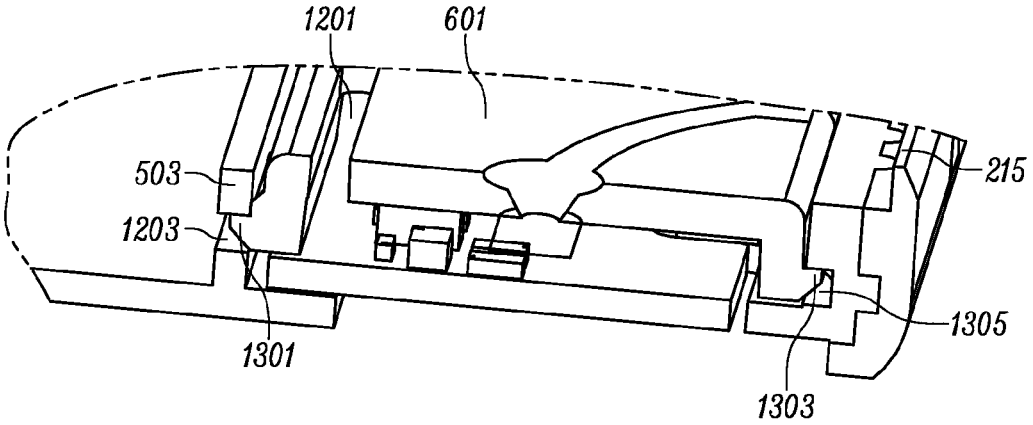
FIG. 13 is a partial cross-sectional view showing a plated antenna carrier snapped into a housing in accordance with an embodiment of the disclosed principles.

The manner in which the plated antenna carrier 601 engages the housing 201 is shown in greater detail in FIG. 13. In the illustrated embodiment, a latch piece 1301 is located on the perimeter of the plated antenna carrier 601 at the slots 1201 and opposite the mating pocket 1203. Similarly, the top perimeter of the plated antenna carrier 601 includes a hook piece 1303 opposite a mating pocket 1305. The placement of the rib 503 is such that the plated antenna carrier 601 is forced towards the metal antenna arm 215, preventing any change in the relative distance between the plated antenna carrier 601 and the antenna arm 215. This provides reliable repeatable coupling between the trace and antenna 215.

With respect to the specific configuration of the antennas and metal traces 901, those of skill in the art will appreciate from the foregoing that the spacing, shape and orientation of the elements can be modified to affect tuning of the antennas. For example, although the antenna arms 211, 213, 215, 217 are shown as straight objects, in an embodiment the terminal end of any or all of the antenna arms is turned to extend toward the main body 219 of the housing 201 so as to lengthen the antenna arm 211, 213, 215, 217 and effectively tune a resonance of the antenna arm 211, 213, 215, 217.

It will be further appreciated by those of skill in the art that the metal traces associated with different antenna arms may be of different lengths and widths, such that the antenna arms have different natural resonant responses over a predetermined frequency range. For example, the predetermined frequency range may be a low frequency range and may include a different low band resonance for each antenna. Similarly, the predetermined frequency range may be a high frequency range and may include a different high band resonance for each antenna.

Moreover, although the leg of the metal trace 901 parallel to the antenna 211, 213, 215, 217 lies in the plane of the PCB 603 in the illustrated embodiment, a different orientation is possible. For example, the metal trace 901 associated with any or all of the antenna arms 211, 213, 215, 217 may be oriented such that its width is parallel to the width of the antenna 211, 213, 215, 217. Although not shown, an additional metal trace may be used in conjunction with an existing metal trace 901 to improve antenna tuning as well. In an embodiment, a grounded metal trace is oriented parallel to but not touching the length of a metal trace 901 coupled to an antenna arm 211, 213, 215, 217, such that the metal trace 901 is between the additional metal trace and the antenna arm.

As noted above, in a given device design, an I/O (input/output) port may fall in between antenna arms. A benefit of the disclosed design is that an I/O port such as port 1205, including a grounded metal sheath, can pass through the non-conductive material in the gap between antenna arms without adversely affecting the performance of the two antenna arms either by its existence or by the insertion of an input/output cable into the input/output port 1205.

It will be appreciated that a new system and method for antenna coupling in a portable communication device having a one-piece metal backing have been disclosed herein. However, in view of the many possible embodiments to which the principles of the present disclosure may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

We claim:

1. A portable electronic device comprising:

a single-piece metallic housing portion having a main body and having a periphery with one or more antenna arms formed in the periphery, each antenna arm comprising a strip of the metallic housing portion electrically connected to the main body of the metallic housing portion at one end and extending to a terminal end, enclosing an opening in the housing except for a gap;

a non-conductive material configured and positioned in the gap and thus, in concert with the one or more antenna arms, fully enclose the opening in the housing, wherein the terminal end of at least one of the antenna arms is turned to extend toward the main body of the single-piece metallic housing so as to lengthen the antenna arm and tune a resonance of the antenna arm;

a metal trace positioned parallel to the one or more antenna arms so as to capacitivly couple to the one or more antenna arms; and a printed circuit board (PCB) disposed within the single piece metallic housing portion.

2. The portable electronic device in accordance with claim 1, wherein the metal trace is plated on the antenna carrier and comprises two legs including a first leg spanning from the feed point to an edge of the antenna carrier nearest a first antenna arm, and a second leg connected to an end of the first leg and spanning a predetermined length parallel to the first antenna arm.

3. The portable electronic device in accordance with claim 2, wherein the second leg of the metal trace further has a thickness defined by a first face and a second face and a width greater than the thickness, defined a first edge and second edge, the second leg being oriented so that one of the first face and the second face faces the first antenna arm.

4. The portable electronic device in accordance with claim 2, further comprising a second metal trace oriented parallel to but not touching the second leg and located such that the second leg is between the second metal trace and the first antenna arm.

5. The portable electronic device in accordance with claim 2, further comprising at least one rib integral with the housing, wherein the at least one rib is formed to latch the antenna carrier in an installed state.

6. The portable electronic device in accordance with claim 1, wherein a second antenna arm includes a feed located and configured to fit with an external contact, wherein the PCB has a soldered contact which makes contact with the feed when the PCB is in an installed condition.

7. A portable electronic device comprising:

a single-piece metallic housing portion having a main body and having a periphery with one or more antenna arms formed in the periphery, each antenna arm comprising a strip of the metallic housing portion electrically connected to the main body of the metallic housing portion at one end and extending to a terminal end, enclosing an opening in the housing except for a gap;

a region of grounded metal through the non-conductive material in the gap, the region of grounded metal containing an input/output connector configured and positioned such that the performance of the two antenna arms is not decreased upon the insertion of an input/output cable into the input/output connector; and a metal trace positioned parallel to the one or more antenna arms so as to capacitivly couple to the one or more antenna arms.

8. A portable electronic device comprising:

a single-piece metallic housing portion having a main body and having a periphery with two or more antenna arms formed in the periphery, each antenna arm comprising a strip of the metallic housing portion electrically connected to the main body of the metallic housing portion at one end and extending to a terminal end, enclosing an opening in the housing except for a gap;

a non-conductive material configured and positioned in the gap and thus, in concert with the two or more antenna arms, fully enclose the opening in the housing; and a metal trace positioned parallel to the two or more antenna arms so as to capacitivly couple to the two or more antenna arms, wherein the metal trace associated with a first of the two or more antenna arms is of a first length and first width, and wherein the metal trace associated with a second of the two or more antenna arms is of a second length and second width different from the first length and first width such that the first and second antenna arms have different natural resonant responses over a predetermined frequency range.

9. The portable electronic device in accordance with claim 8, wherein the predetermined frequency range includes a different low band resonance for each antenna arm.

10. The portable electronic device in accordance with claim 8, wherein the predetermined frequency range includes a different high band resonance for each antenna arm.

11. A portable electronic device comprising:

a single-piece metallic housing portion having a main body and having a periphery with one or more antenna arms formed in the periphery, each antenna arm comprising a strip of the metallic housing portion electrically connected to the main body of the metallic housing portion at one end and extending to a terminal end, enclosing an opening in the housing except for a gap, wherein the housing includes two openings, each opening being partially bordered by two antenna arms having a gap between their terminal ends, each gap being closed by a non-conductive material, fully enclose the opening in the housing; and a metal trace positioned parallel to the one or more antenna arms so as to capacitivly couple to the one or more antenna arms.

12. The portable electronic device in accordance with claim 11, wherein the two openings are located at opposite ends of the housing.

13. A portable electronic device comprising:

a one-piece conductive housing having one or more antenna arms formed therein, the one-piece conductive housing having an inner surface and an outer surface;

a metal trace within and adjacent to the inner surface of the one-piece conductive housing, the metal trace having a thickness between a first face and a second face and a width greater than the thickness, and wherein one of the first face and the second face faces the antenna arm; and a capacitive link between the metal trace and one of the antenna arms.

14. The portable electronic device in accordance with claim 13, further including one or more alignment elements to maintain the metal trace in a fixed spatial relationship to the one or more antennas.

15. The portable electronic device in accordance with claim 14, wherein the metal trace resides on an antenna carrier.

16. The portable electronic device in accordance with claim 15, wherein the metal trace on the antenna carrier is linked to a PCB in the portable electronic device.

17. The portable electronic device in accordance with claim 14, wherein the metal trace is fabricated as part of a printed circuit board (PCB).

18. The portable electronic device in accordance with claim 13, wherein at least one of the antenna arms is turned to extend toward an interior of the device so as to lengthen the antenna arm and tune a resonance of the antenna arm.

19. The portable electronic device in accordance with claim 13, further comprising an additional metal trace parallel to but not touching the metal trace such that the metal trace is between the additional metal trace and the antenna arm.

20. An antenna system for a portable electronic device, the antenna system comprising:

a generally rectangular unitary plate of conductive material having an opening at each end thereof, each opening being partially bounded by a pair of strips of the conductive material such that there is a gap between the ends of each pair of strips, each strip forming an antenna;

a non-conductive divider filling the gaps between the ends of each pair of strips; and a metallic trace being configured and positioned to capacitivly couple to at least one of the antennas, the metal trace having a thickness between a first face and a second face and a width greater than the thickness, and wherein one of the first face and the second face faces the at least one antenna.

* * * * *